US005807211A

United States Patent [19]

Berryhill

[11] Patent Number: 5,807,211

[45] Date of Patent: Sep. 15, 1998

[54] EXERCISE DEVICE ADAPTABLE FOR USE BY PHYSICALLY WEAK AND DEBILITATED INDIVIDUALS

[76] Inventor: John H. Berryhill, 672 Maple, Smithfield, Utah 84335

[21] Appl. No.: 565,088

[22] Filed: Nov. 30, 1995

[51] Int. Cl.[6] ..... A63B 22/06; A63B 21/04

[52] U.S. Cl. ..... 482/57; 482/904; 482/129

[58] Field of Search ..... 482/52, 57, 60, 482/62, 904, 138, 121, 79, 80, 137

[56] References Cited

U.S. PATENT DOCUMENTS

| | | | |
|---|---|---|---|
| 2,673,088 | 3/1954 | Wentz | 482/60 |
| 3,443,664 | 5/1969 | Frassanito | 482/57 |
| 3,751,033 | 8/1973 | Rosenthal | 482/60 |
| 4,373,716 | 2/1983 | Pagani | 482/62 X |
| 4,538,804 | 9/1985 | Zibell | 482/57 |
| 5,039,088 | 8/1991 | Shifferaw | 482/51 |
| 5,178,591 | 1/1993 | Lyons | 482/52 |
| 5,299,992 | 4/1994 | Wilkinson | 482/57 X |
| 5,338,277 | 8/1994 | Yang | 42/137 X |
| 5,496,236 | 3/1996 | Buonauito | 482/57 |
| 5,613,924 | 3/1997 | Lee | 482/51 |

FOREIGN PATENT DOCUMENTS

| | | | |
|---|---|---|---|
| 1516401 | 7/1969 | Germany | 482/904 |
| 4214629 | 11/1993 | Germany | 482/142 |
| 1326292 | 7/1987 | U.S.S.R. | 482/137 |

OTHER PUBLICATIONS

Marcy, Gym Equipment Company, Dec. 10(1990) (see H–611).

*Primary Examiner*—Richard J. Apley
*Assistant Examiner*—William Lamarca
*Attorney, Agent, or Firm*—Thorpe, North & Western, L.L.P.

[57] ABSTRACT

An exercise device is provided which is particularly adapted for use by individuals while seated in a stationary chair. The inventive exercise device employs a folding frame to which are attached bicycle type pedals, a leg press bar, and resistance pulls. The bicycle type pedals are attached to one side of the folding frame, the leg press bar hangs from a horizontal bar on the opposite side of the folding frame, and the resistance pulls are also attached to the other side of the folding frame, opposite the bicycle type pedals. By positioning the front of the exercise device in front of an individual seated in a chair, pedaling exercises can be accomplished. By positioning the rear of the exercise device in front of a seated individual, exercises utilizing the leg press and resistance pulls can be accomplished.

20 Claims, 6 Drawing Sheets

EXERCISE DEVICE ADAPTABLE FOR USE BY PHYSICALLY WEAK AND DEBILITATED INDIVIDUALS

BACKGROUND

1. The Field of the Invention

This invention relates generally to exercise equipment and more specifically to exercise equipment designed for use while in a seated position.

2. The Background Art

As the average life span increases so too does the need for geriatric care including physical therapy and exercise. Although a plethora of exercise equipment exists, few of these can be effectively utilized by geriatric patients. Even fewer are adaptable for use by geriatric patients who are confined to wheelchairs for most of their day. Among these, those available for use in home are severely limited or nonexistent.

For convenience and other reasons, a growing number of geriatric or wheelchair bound patients are receiving physical therapy in their homes. This care is typically provided by a home health therapist. These therapists come to the patient's home to provide physical therapy and exercise in a similar fashion to what might be administered at a hospital or other care facility.

Such home health therapist are hampered, however, by the lack of access to physical therapy and exercise equipment. While hospitals and care facilities can devote large spaces for the installation of physical therapy and exercise equipment, the home health therapist is limited to what can be transported with them.

The result of this situation is that home health therapists commonly rely on physical therapy and exercise which can be conducted primarily without the use of equipment. This often means that the home health therapist receives more of a workout than the patient they are treating since many such therapies and exercise require a great expenditure of effort from the therapist. While these methods can provide adequate care, they have the drawback of limiting the amount of therapy a therapist can conduct in a day. Further, such exercises and therapy require the interaction of a therapist and, therefore, cannot be practiced by the patient alone.

Another area of society which experiences similar difficulties is that of the business executive or desk worker. Although these individuals are typically able to operate much of today's exercise equipment, the majority of executives and desk workers must leave the office in order to exercise. Although some executives have incorporated exercises equipment of one type or another into their office, the great majority have not. This may be due in part to lack of space for exercise equipment. This may also be due to the difficulty of utilizing exercise equipment in an office environment.

It would therefore be an advancement in the art to provide a small lightweight exercise and therapy device which is easily transportable and designed for use while seated.

BRIEF SUMMARY AND OBJECTS OF THE INVENTION

The present invention provides an exercise device designed for use while seated. The exercise device of the present invention employs a folding frame to which are attached apparatus designed to exercise both the lower and upper portions of the body. The exercise device of the present invention is also designed to be lightweight, easily transportable, and small enough to fit under most desks.

In a preferred embodiment, the apparatus attached to the folding frame includes bicycle type pedals, a leg press bar, and resistance pulls. The bicycle type pedals are attached to one side of the folding frame, the leg press bar hangs from a horizontal bar mounted near the top of the opposite side of the folding frame, and the resistance pulls are attached to the other side of the folding frame, opposite the bicycle type pedals.

In the folded position, the two main portions of the folding frame are designed to snug up to one another being separated only enough to accommodate the leg press bar. The bicycle type pedals swing into line with one side of the folding frame. The resistance pulls may be wrapped around the frame to reduce the tendency of the main portions of the folding frame to move away from one another for transportation purposes.

In use, the main portions of the folding frame are designed to rotate on a hinge joining the tops of each of the main portions. The amount of rotation is limited by the hinge apparatus such that the main portions of the folding frame form a modified A-frame when deployed into position.

Locking tabs spring into engagement when the main portions of the folding frame are deployed into position thus preventing collapse of the device or unwanted repositioning during use. When the main portions of the folding frame have been deployed into position, the user may choose to utilize the three exercise apparatus in a variety of ways.

To use the bicycle type pedals, the folding frame is moved into position near the user, the user being seated in a chair. The main portion of the folding frame to which the bicycle type pedals are attached is placed facing the user. Straps are used to secure the folding frame to a chair, other furniture, or other item which is adequately stable. This mechanism prevents travel of the frame across the floor during use. The user is then free to place his feet on the pedals, or may be assisted in placing his feet on the pedals, and begin pedaling. The resistance encountered in pedaling is adjustable through a tension knob located on the cross piece of the bicycle type pedals.

To use the leg press bar, the folding frame is again moved into position near the user this time with the main portion of the folding frame to which the resistance pulls are attached facing the user. Stabilizing straps are attached and positioned to prevent travel of the frame across the floor during use. The user then places their feet on the foot pegs of the leg press. This positioning requires that the user's legs be positioned on either side of the central frame of the main portion to which the resistance pulls are attached. If needed, the user may be assisted in the proper positioning of their legs. The user is then free to utilize the leg press feature by pushing the leg press bar away from their body with their feet.

Use of the resistance pulls can be accomplished in several ways. Preferably, if the user is capable of applying adequate pressure, the user positions his feet on the portions of the folding frame which are resting on the floor. The individual then grasps the handles of the resistance pulls and pulls up perpendicularly. If the individual is unable to exert adequate pressure to hold the exercise device in place, weights may be positioned to do so or a therapist or other assistant may provide the required stabilization.

Accordingly, it is a primary object of the present invention to provide an exercise device which can be utilized by individuals from a seated position.

It is a further object of the present invention to provide an exercise device which can be utilized by individuals in a seated position.

It is a further object of the present invention to provide an exercise device which can provide for both upper and lower body exercise.

It is a still further object of the present invention to provide an exercise device which is small and lightweight.

An additional object of the present invention is to provide an exercise device which can be easily transported from location to location.

Yet another object of the present invention is to provide an exercise device which can be stored in a small space.

A further object of the present invention is to provide an exercise device which can be utilized when positioned under a desk or table.

A still further object of the present invention is to provide an exercise device which can be used for in home therapy and exercise.

These and other objects of the present invention will become more fully apparent from the following description and appended claims or may be learned by the practice of the invention as set forth herein.

BRIEF DESCRIPTION OF THE DRAWINGS

In order to more fully understand the manner in which the above-recited and other advantages and objects of the present invention are obtained, a more particular description of the invention briefly described above will be rendered by reference to the presently understood best mode for making and using the same, as illustrated in the appended drawings. Understanding that these drawings depict only typical embodiments of the invention and are, therefore, not to be considered as limiting of its scope, the invention will be described with additional specificity and detail through the use of the accompanying drawings in which.

DETAILED DESCRIPTION OF THE PREFERRED EMBODIMENTS

Figure 1:
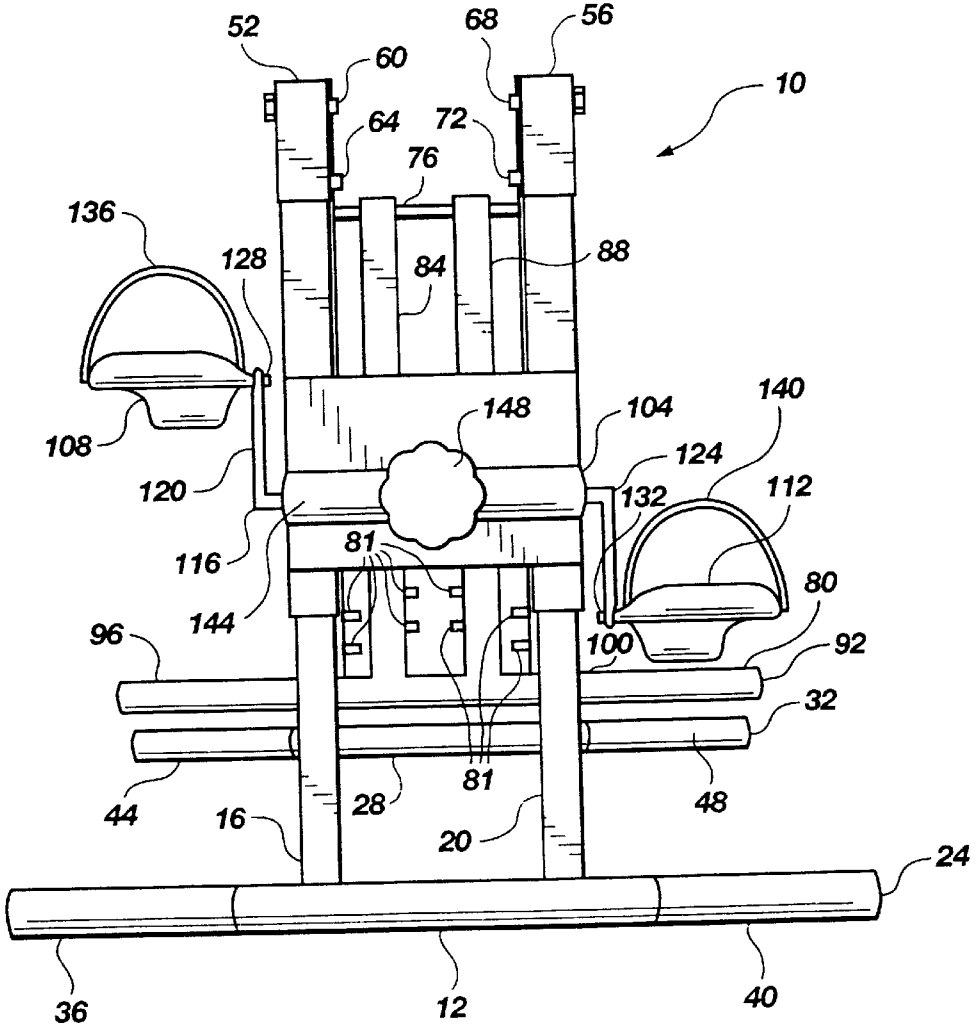
FIG. 1 is a front perspective view of the exercise device of the present invention in the unfolded position.
Figure 2:
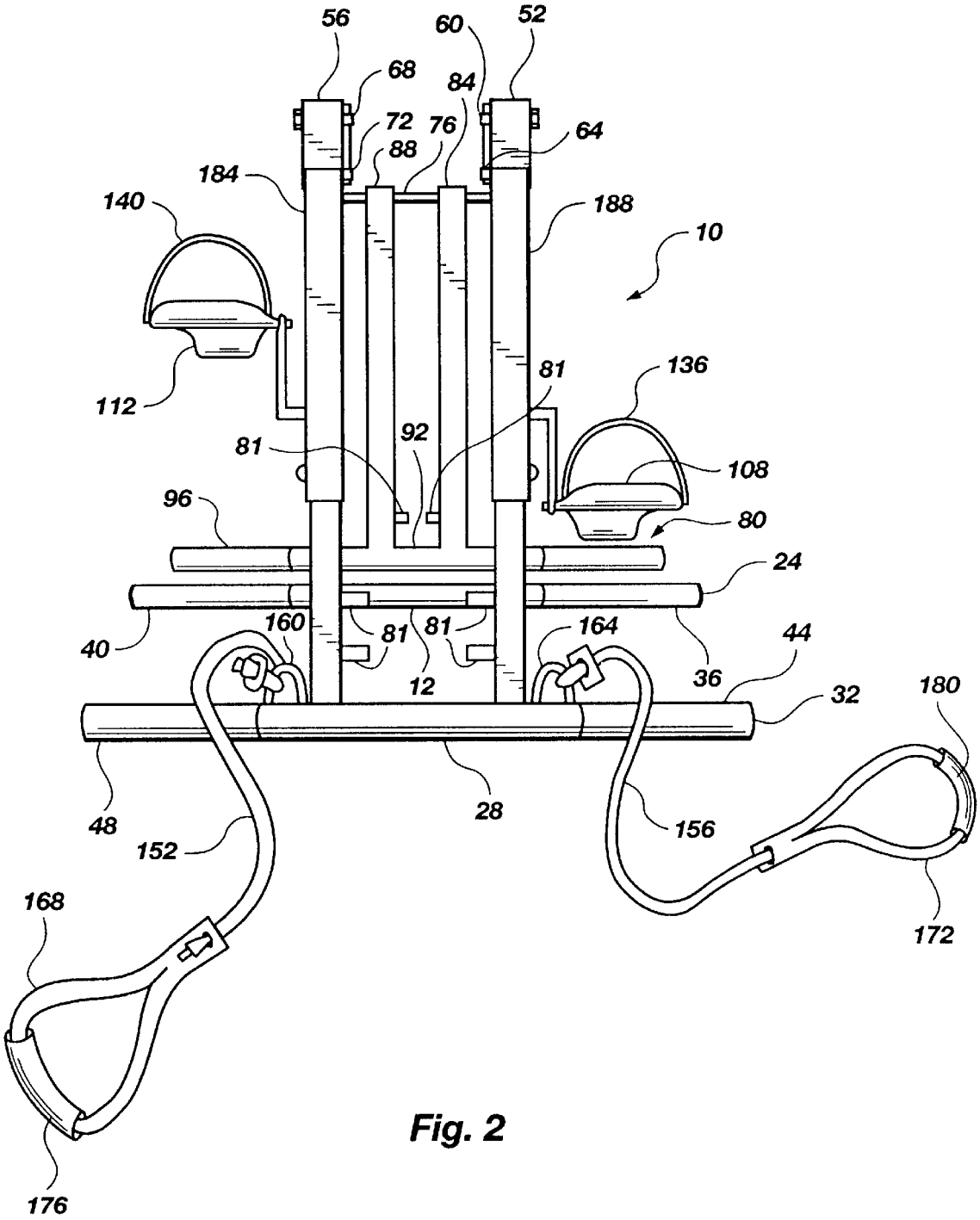
FIG. 2 is a rear perspective view of the exercise device of the present invention in the unfolded position.
Figure 3:
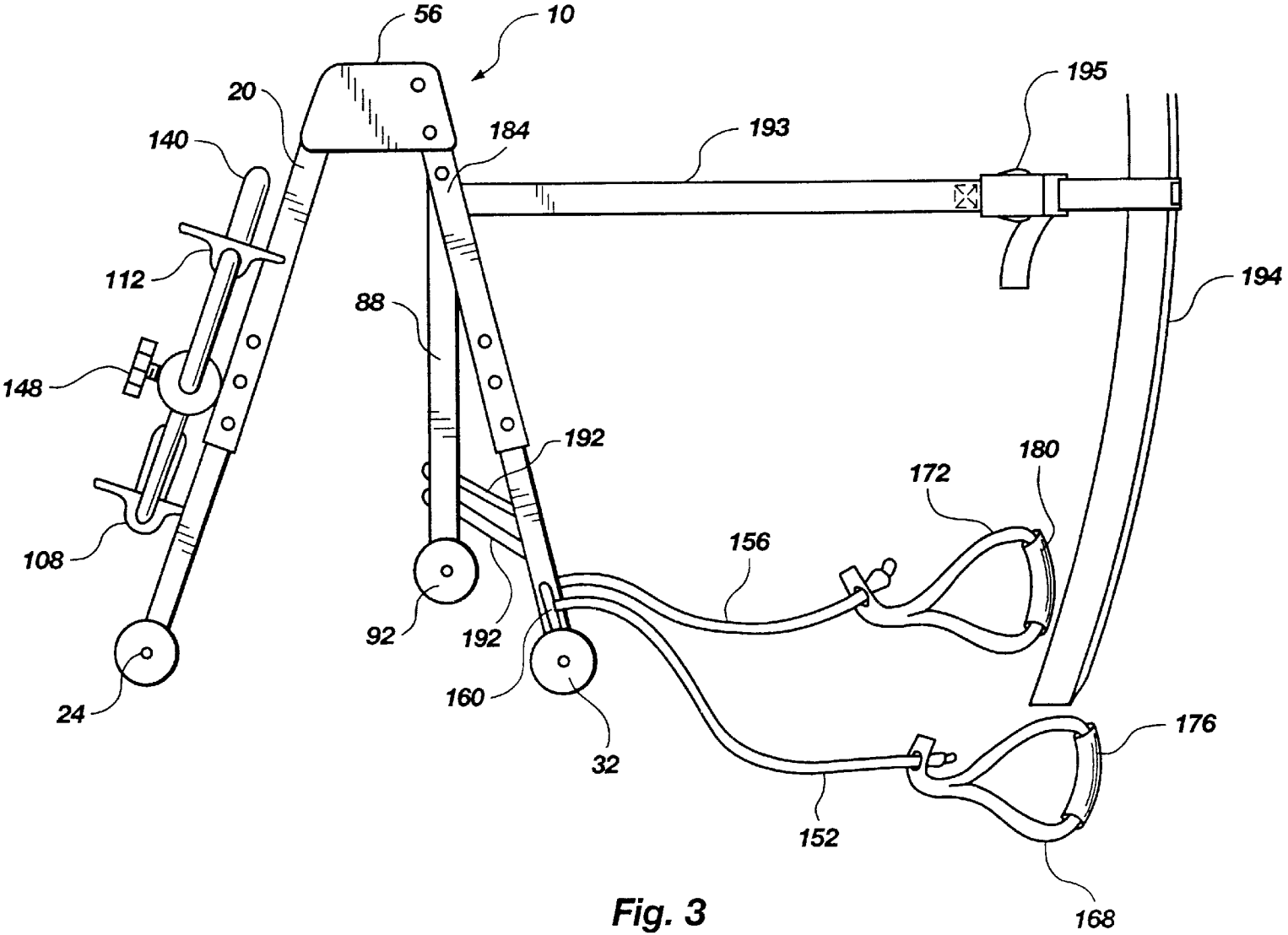
FIG. 3 is a side view of the exercise device of the present invention in the unfolded position.

Reference is now made to the embodiments and methods illustrated in FIGS. 1 through 6 wherein like numerals are used to designate like parts throughout. FIGS. 1 through 3 show the exercise device of the present invention in an unfolded position. Turning to FIG. 1, the exercise device of the present invention is shown generally at 10. A front tubular portion 12 is represented employing a first vertical member 16, a second vertical member 20, and a horizontal member 24. Front tubular portion 12 is connected to a rear tubular portion 28 of which only the horizontal member 32 is visible in this view.

In the unfolded position depicted in FIG. 1, exercise device 10 would preferably have overall dimensions of approximately nineteen to twenty-two inches high, twenty-four inches long, and a width of nineteen to twenty-two inches which varies with the height. The height of exercise device is adjustable to allow the user to adjust exercise device 10 to maximize comfort during use. The width naturally varies inversely to the height, that is the greater the height, the less the width and the less the height the greater the width. The height adjustments are limited by the size of the folding frame and the distance required to allow the bicycle type pedals and leg press bar to operate.

As will be appreciated, this relatively small overall size allows exercise device 10 to be easily transported and stored. Additionally, exercise device 10 can be utilized even in cramped quarters.

A variety of materials can be effectively employed to construct front tubular portion 12 and rear tubular portion 28. Materials should be those which are capable of withstanding torque and other forces associated with use of exercise device 10. Metal, plastics, and graphite would be among the materials which would meet these requirements. In a preferred embodiment, front tubular portion 12 and rear tubular portion 20 are constructed of steel tubing. Steel tubing is strong and lightweight thus providing a frame capable of withstanding the stresses involved during use of exercise device 10 while also enhancing the transportability of exercise device 10.

In a preferred embodiment, front horizontal member 24 employs a first gripping sleeve 36 and a second gripping sleeve 40. Similarly, rear horizontal member 32 employs a first gripping sleeve 44 and a second gripping sleeve 48. These gripping sleeves are preferably constructed as rubberized tubes having a gripping pattern embossed therein. These rubberized tubes are then slipped over the each end of both the front horizontal member 24 and the rear horizontal member 32.

The gripping sleeves are intended to provide a non-marring, non-skid surface and materials and methods of application to reach such results as are encompassed within the scope of the present invention. For example, a variety of plastic and rubberized materials could be used in the construction of the gripping sleeves. Additionally, the gripping sleeves could be fashioned as actual sleeves so as to slip on over the ends of front horizontal member 24 and rear horizontal member 32 or could be applied using other methods. For example, the gripping sleeves might employ a spray on material which would form the gripping sleeve around front horizontal member 24 and rear horizontal member 32 when applied.

Preferably, first vertical member 16 and second vertical member 20 of front tubular portion 12 are positioned parallel to each other and approximately six inches apart. First vertical member 16 and second vertical member 20 of front tubular portion 12 are then connected, at the lower edge, to horizontal member 24 which is perpendicular to first vertical member 16 and second vertical member 20 of front tubular portion 12.

Front tubular portion 12 and rear tubular portion 28 are connected via a first hinge mechanism 52 and a second hinge mechanism 56. First hinge mechanism 52 employs a first bolt and lock nut assembly 60. Also associated with first hinge mechanism 52 is first locking tab 64. Similarly, second hinge mechanism 56 employs a second upper bolt and lock nut assembly 68. Associated with second hinge mechanism 56 is second locking tab 72.

In use, these hinges and associated bolt and lock nut assemblies allow positioning of the front tubular portion 12 and the rear tubular portion 28 when they are extended into position around first hinge mechanism 52 and second hinge mechanism 56. When the desired deployed positioning is achieved, the locking tabs serve to prevent unwanted collapse of exercise device 10. As will be appreciated, additional locking tabs may be employed if desired for additional protection against unwanted collapse.

Also depicted in FIG. 1 is horizontal bar 76 from which the leg press bar assembly depicted generally at 80 hangs. Leg press bar assembly 80 includes a first vertical member 84 and a second vertical member 88 which are attached at the lower portion to a horizontal member 92. First vertical member 84 and second vertical member 88 are fashioned so as to allow horizontal bar 76 to pass therethrough. As will be appreciated, leg press bar assembly might employ a single vertical member as an alternate embodiment to achieve the same effect.

Leg press bar assembly 80 also employs a first foot peg 96 and a second foot peg 100 located at the outer extremities on the horizontal member 92. Leg press bar assembly 80 is designed to rotate around the axis formed by horizontal bar 76 when force is applied by a user.

Resistance knobs or pegs 81 allow for attachment of resistance lengths (not shown) so as to provide resistance when leg press bar assembly 80 is in use. Attachment of resistance lengths to resistance knobs 81 in varying configurations allows for varying use of exercise device 10.

A bicycle type pedal assembly, depicted generally at 104, is also illustrated in FIG. 1. As shown, a first bicycle type pedal 108 and a second bicycle type pedal 112 are connected to a shaft 116. Shaft 116 employs a first perpendicular portion 120 and a second perpendicular portion 124 to which first bicycle type pedal 108 and second bicycle type pedal 112 are attached respectively.

First bicycle type pedal 108 and second bicycle type pedal 112 are connected to first perpendicular portion 120 and second perpendicular portion 124 in such a way as to be rotatably attached to first peg 128 and second peg 132. A variety of such attachment means are well known in the art. First bicycle type pedal 108 and second bicycle type pedal 112 also employ a first toe loop 136 and a second toe loop 140. A user places his feet into the toe loops and onto the pedals when using the bicycle portion of exercise device 10.

Shaft 116 is partially encased in housing 144 to which tension knob 148 is attached. By rotating tension knob 148, the resistance force applied to shaft 116 can be increased or decreased in accordance with the needs of the user.

In use, the exercise device 10 is positioned at a comfortable distance in front of a seated individual. The exercise device is stabilized by attaching stabilizing straps (not shown) to the device and around a stabilizing object such as another chair or other piece of furniture. The user places his left foot through first toe loop 136 and onto first pedal 108. The user places his right foot through second toe loop 140 and onto second pedal 112. The user then pedals as they would a bicycle. Resistance can be increased or decreased by rotating tension knob 148 so as to obtain the desired level of effort.

In a similar fashion, bicycle type pedal assembly 104 may be utilized to exercise the upper extremities. In such a case, exercise device 10 would be secured to a table placed in front of a seated individual. Instead of placing their feet on the pedals, the user would place their hand on the pedals thus using their hands to rotate the pedals.

Turning to FIG. 2, a rear view of exercise device 10 in the unfolded position is depicted. When facing this side of exercise device 10, a user is able to utilize the leg press and resistance pull features of the device. As illustrated, a first resistance pull 152 and a second resistance pull 156 are attached to rear horizontal member 32 through a first loop 160 and a second loop 164 respectively.

First resistance pull 152 and second resistance pull 156 are attached to first loop 160 and second loop 164 by attachment means 165. As depicted here attachment means 165 allows for a loop of the material of the resistance pull to be placed through the loop and fastened. Other attachment means could also be effectively employed.

Preferably first resistance pull 152 and second resistance pull 156 will be constructed of surgical tubing or other similar material. As depicted, a first grip 168 is fashioned as the distal end of first resistance pull 152. Similarly, a second grip 172 is fashioned at the distal end of second resistance pull 156.

In this embodiment, first grip 168 and second grip 172 also employ a first comfort sleeve 176 and a second comfort sleeve 180. First comfort sleeve 176 and second comfort sleeve 180 are designed to minimize the stress applied to the user by providing a padded area to grasp.

In use, first resistance pull 152 and second resistance pull 156 can be employed to accomplish a variety of exercises. With the user in a seated position, the user grasps the first resistance pull in their left hand and the second resistance pull in their right hand. By curling the arms, the user can accomplish arm curls. A related exercise, wrist curls, are done by flexing the wrist toward the upper arm while grasping the resistance pull.

Military presses, with the user's hands positioned at his sides with elbows bent and shoulders oriented at ninety degrees can also be performed. In this position, the user then presses overhead to accomplish this exercise.

Additionally, specific areas of the body may be exercised using the resistance pulls. To exercise the anterior and middle deltoid, the resistance pulls are grasped, arms are held in front and lifted with arms straight out or with arms elevated and straight or with elbows bent. Exercising the posterior deltoid and mid back can be accomplished by pulling the handgrips toward the chest.

First resistance pull 152 and second resistance pull 156 also can be used to perform leg exercises. To accomplish these exercise, the user places their feet (rather than their hands) into first grip 168 and second grip 172 and the exercise is performed.

Leg press assembly 80 is also utilized from this side of exercise device 10. In use, exercise device 10 is stabilized using stabilizing straps (shown in FIG. 3) such that the rear tubular portion 28 is facing the user. A length of tubing known in the industry as theratubing is attached from the leg press assembly 80 to rear tubular portion 28. This provides the resistance during exercise involving leg press assembly 80. The amount of resistance can be adjusted by adjusting the length of the theratubing or the thickness of theratubing employed. As will be appreciated, rubber resistance bands or other similar mechanism may be used in place of the theratubing.

When exercise device 10 is properly adjusted for the user, the user places their left foot on first foot peg 96 and their right foot on second foot peg 100. The user then pushes the leg press assembly 80 away from them using, as much as possible, equal weight distribution.

Further details of rear tubular portion 28 are also depicted in this figure. Similarly to front tubular portion 12, rear tubular portion 28 employs a first vertical member 184 and a second vertical member 188. Also as with front tubular portion 12, first vertical member 184 and second vertical member 188 of rear tubular portion 28 are positioned parallel to each other and approximately six inches apart. First vertical member 184 and second vertical member 188 of rear tubular portion 28 are then connected, at the lower edge, to horizontal member 32 which is perpendicular to first vertical member 184 and second vertical member 188 of rear tubular portion 28.

Turning to FIG. 3, a side view of exercise device 10 unfolded to a nineteen inch width is shown, whereby frame members 20 and 184 define a "A" frame shape in the operative position shown in FIG. 3. As can best be seen in this view resistance length 192 attaches from leg press assembly 80 to rear tubular portion 28. As will be appreciated, resistance length 192 serves to oppose force exerted by the user on leg press assembly 80. Resistance length 192 is preferably constructed of theratubing. Alternatively, resistance length 192 may employ a rubber resistance band. The amount of resistance can be varied by employing varying thicknesses of theratubing or using additional thicknesses of theratubing. Similarly, if a rubber resistance band is employed, resistance can be varied by utilizing various thicknesses of rubber resistance band or by employing greater or fewer numbers of rubber resistance bands.

Also depicted in FIG. 3 is stabilizing strap 193. Stabilizing strap 193 is shown attached to a common chair leg 194. Adjustment mechanism 195 allows for stabilizing strap 193 to be adjusted to the appropriate length to provide adequate stabilization in each varying situation. As will be appreciated, a number of mechanisms such as a locking buckle, an adjustable belt, a hook strap, or other similar adjustable device could be implemented as adjustment mechanism 195. FIG. 3 illustrates the ability of the present inventive device to be used in a variety of settings. A typical scenario would involve the use of the present inventive exercise device at home by a debilitated individual. The stabilizing strap 193 will be used to stabilize exercise device 10 in the desired position, that is either with the bicycle type pedals 104 facing the individual or with the leg press assembly 80 and resistance pulls 152 and 156 facing the individual. As described throughout this specification, a variety of exercise are then available to the individual.

Figure 4:
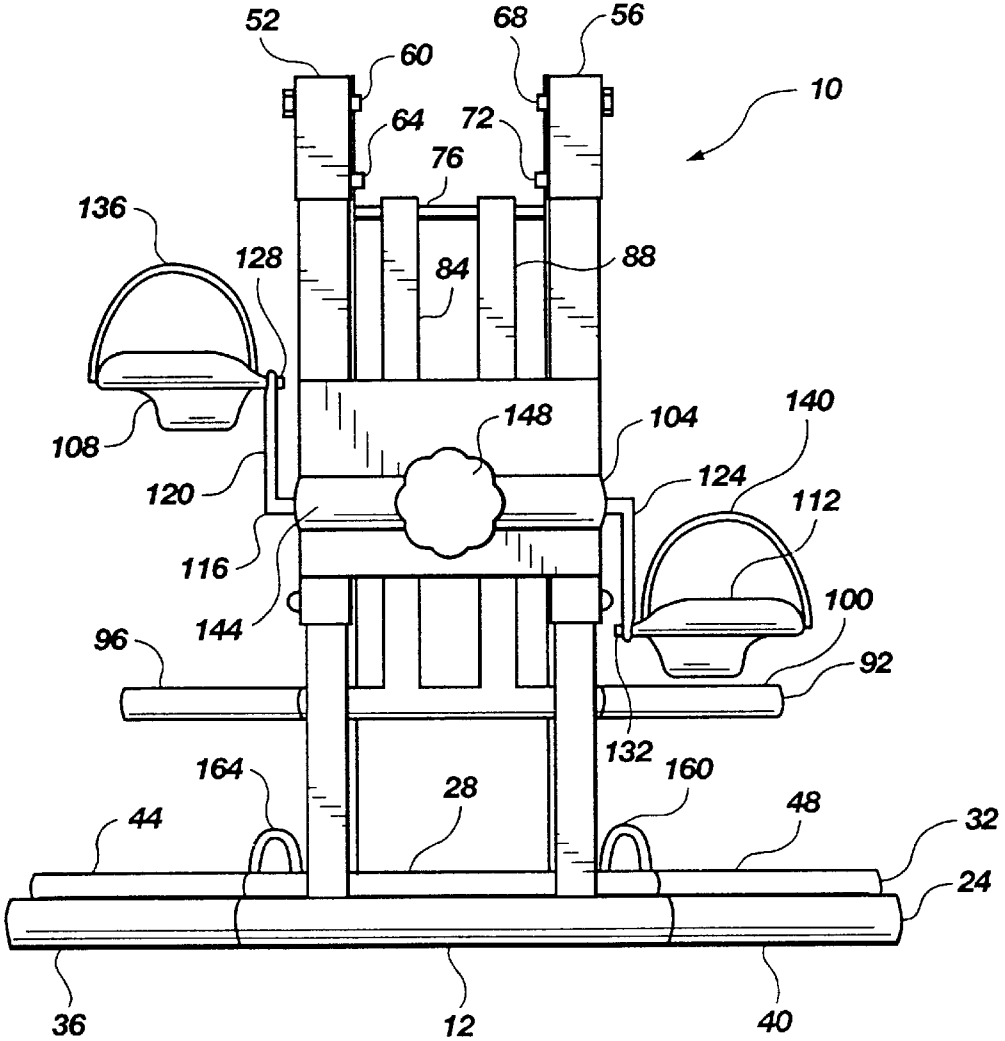
FIG. 4 is a front perspective view of the exercise device of the present invention in the folded position.
Figure 5:
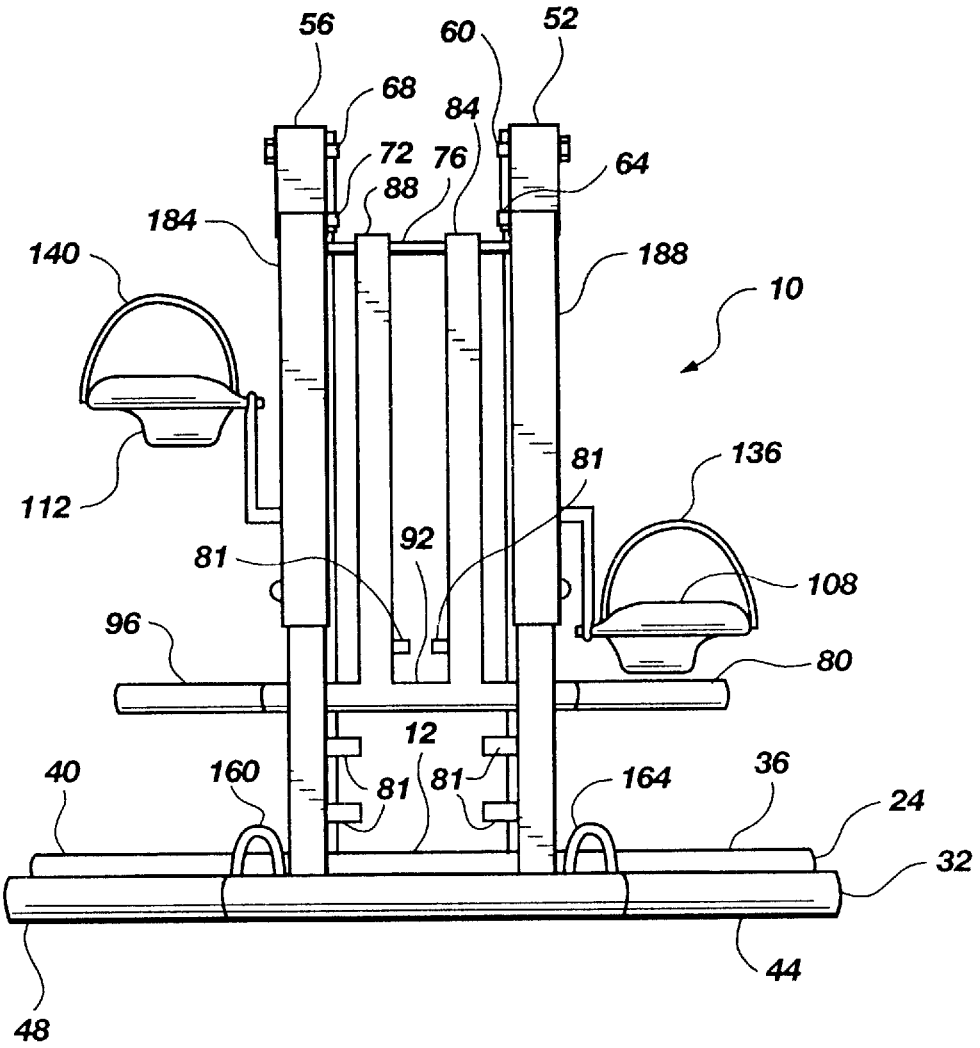
FIG. 5 is a rear perspective view of the exercise device of the present invention in the folded position.
Figure 6:
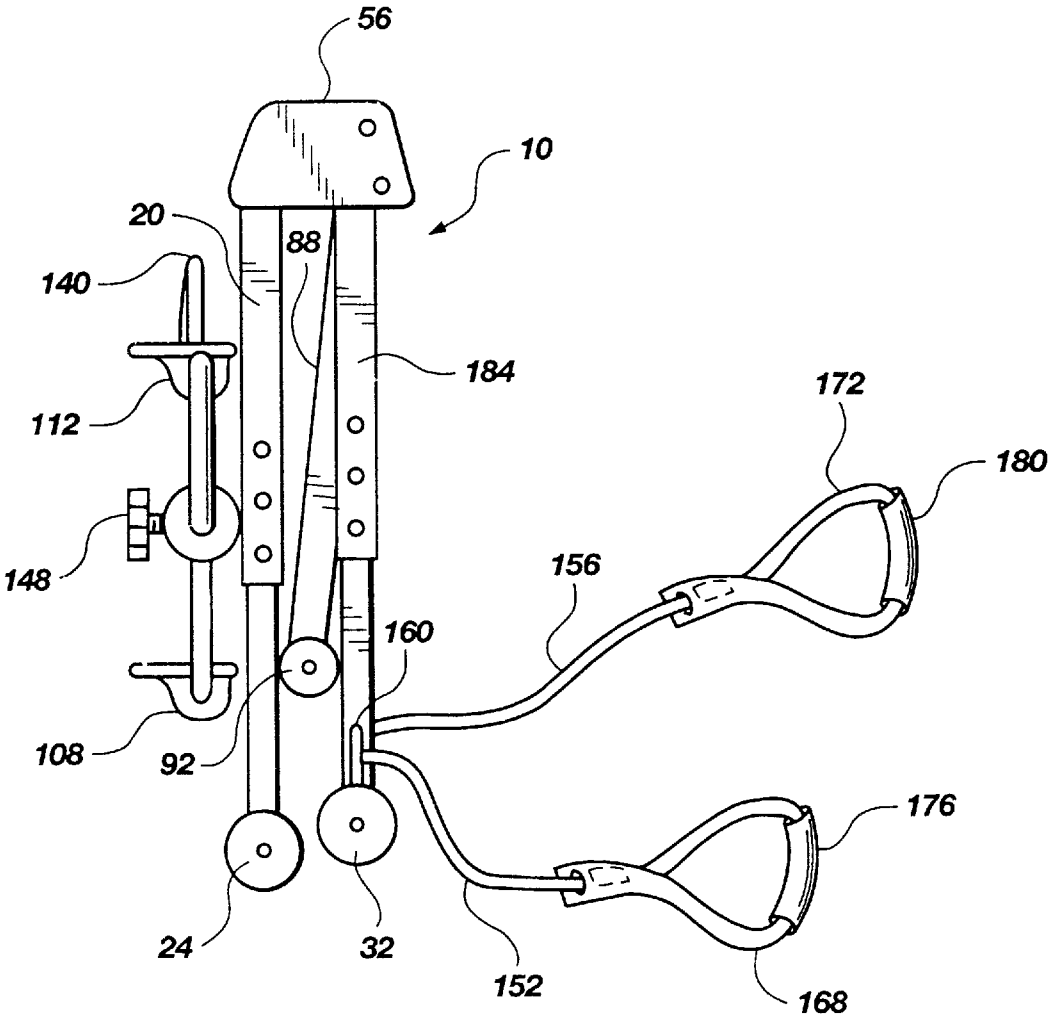
FIG. 6 is a side view of the exercise device of the present invention in the folded position.

FIGS. 4 through 6 depict exercise device 10 in the folded position ready for transport. In the folded position, the overall dimensions of exercise device 10 are approximately twenty-one inches high, twenty-four inches long, and three inches wide. As will be appreciated, this size allows for ease in both transportation and storage.

In FIG. 4, exercise device 10 is seen from the front in the folded position. As illustrated, bicycle type pedal assembly 104 has been adjusted such that first bicycle type pedal 108 is in the upward position and second bicycle type pedal 112 is in the downward position. With this positioning, front tubular portion 12 is able to move as close as possible to rear tubular portion 28.

Turning to FIG. 5, it can be seen that the resistance length has been removed from extension knobs 81. The resistance pulls have also been removed from first loop 160 and second loop 164. If preferred, the resistance pulls may remain on first loop 160 and second loop 164. If left on, it may be desirable to wrap the resistance pulls around exercise device 10 so as to aid in maintaining exercise device 10 in the folded position and to keep the resistance pulls from becoming entangled. It should be noted, however, that wrapping resistance pulls around exercise device 10 may result in inadvertent damage from the resistance pulls becoming pinched by exercise device 10.

The ability of exercise device 10 to be folded into a remarkably small size is best appreciated from the side view illustrated in FIG. 6. In this view it can be appreciated that bicycle type pedal assembly must be positioned so as to have first bicycle pedal 108 and second bicycle pedal 112 in substantially the up and down positions. With bicycle pedal assembly in this position, leg press assembly 80 can nest between front tubular portion 12 and rear tubular portion 28. In this position, exercise device 10 is ready for transport or storage.

Stated another way, FIG. 6 illustrates that the crank arms of the pedals 108 and 112, and the leg press bar, are positionable into substantially parallel positions with respect to at least one of the members 20 and 184 into a compact configuration when said members 20 and 184 are pivoted into a storage position. More specifically, FIG. 6 illustrates that any member of the group consisting of the member 20, the member 184, the leg press bar and the crank arms of the pedals 108 and 112 forms an acute angle of less than twenty degrees with respect to each of the remaining members of said group and without forming an angle greater than twenty degrees with respect any other member of said group when said members 20 and 184 are pivoted into a storage position.

The invention may be embodied in other specific forms without departing from its spirit or essential characteristics. The described embodiments are to be considered in all respects only as illustrative and not restrictive. The scope of the invention is, therefore, indicated by the appended claims, rather than by the foregoing description. All changes which come within the meaning and range of equivalency of the claims are to be embraced within their scope.

What is claimed and desired to be secured by united states letters patent is:

1. An exercise device comprising:

frame means for supporting exercise apparatus located thereon, said frame means comprising a first frame member having an upper portion pivotally attached to an upper portion of a second frame member, said frame members defining an "AA" frame shape when pivoted outwardly away from each other into an operative position, said exercise apparatus comprising:

a leg press bar disposed in swinging engagement with an upper half of at least one of the frame members of said frame means;

a plurality of pedals disposed in rotating engagement with at least one of the frame members of said frame means; and a plurality of resistance pulls attached to at least one of the frame members of said frame means.

2. An exercise device as defined in claim 1 wherein said exercise device further comprises hinge means for allowing said frame means to fold and unfold to varying positions.

3. An exercise device as defined in claim 2 further comprising locking tab means for preventing unwanted collapse of the exercise device once said frame has been unfolded to a desired position.

4. An exercise device as defined in claim 1 wherein said exercise device further comprises a plurality of resistance means for providing varying resistance during exercises employing said leg press bar.

5. An exercise device as defined in claim 4 wherein said resistance means comprises theratubing.

6. An exercise device as defined in claim 1, wherein the exercise apparatus further comprises:

a plurality of pedals disposed in rotating engagement with at least one of the frame members of said frame means; and a plurality of resistance pulls attached to at least one of the frame members of said frame means.

7. An exercise device comprising:

frame means for supporting exercise apparatus located thereon, said frame means comprising a first frame member having an upper portion pivotally attached to an upper portion of a second frame member, said frame members defining an "A" frame shape when pivoted outwardly away from each other into an operative position, said exercise apparatus comprising:

a leg press bar disposed in swinging engagement with an upper half of at least one of the frame members of said frame means:

wherein the pivotal attachment of the frame members is sufficient to enable said frame members to be pivoted inwardly toward each other into a storage position during periods of nonuse, said exercise device further comprising a plurality of pedals disposed in rotating engagement with at least one of the frame members of said frame means, and wherein each pedal comprises a crank arm and a foot support rotatably disposed on said crank arm, and wherein each crank arm and the leg press bar are positionable into substantially parallel positions with respect to at least one of the frame members into a compact configuration when said frame members are pivoted into the storage position.

8. An exercise device as defined in claim 7, wherein any member of the group consisting of the first frame member, the second frame member, the leg press bar and the crank arms of the pedals forms an acute angle of less than twenty degrees with respect to each of the remaining members of said group and without forming an angle greater than twenty decrees with respect any other member of said group when said frame members are pivoted into the storage position.

9. An exercise device as defined in claim 1 further comprising a stabilizing means for stabilizing the exercise device in relation to the forces present while in use.

10. An exercise device as defined in claim 9 wherein said stabilizing means comprises an adjustable strap thereby allowing for stabilization of the exercise device by attachment of the exercise device to a stationary object in the vicinity of the exercise device.

11. An exercise device as defined in claim 1 wherein each frame member includes a support foot disposed on a lower portion thereof for supporting each of said frame members upon a support surface in the operative "A" frame position, said frame members extending upwardly from the support feet when disposed in the operative "AA" frame position and mergeably terminating in a junction forming the pivot point.

12. An exercise device as defined in claim 1 further comprising locking tab means for preventing unwanted collapse of the exercise device once said frame as been unfolded to a desired position.

13. An exercise device as defined in claim 12 wherein said exercise device further comprises a plurality of resistance means for providing varying resistance during exercises employing said leg press bar.

14. An exercise device as defined in claim 1 wherein the pivotal attachment of the frame members is sufficient to enable said frame members to be pivoted inwardly toward each other into a storage position during periods of nonuse, said exercise device further comprising a plurality of pedals disposed in rotating engagement with at least one of the frame members of said frame means, and wherein each pedal comprises a crank arm and a foot support rotatable disposed on said crank arm, and wherein each crank arm and the leg press bar are positionable into substantially parallel positions with respect to at least one of the frame members into a compact configuration when said frame members are pivoted into the storage position.

15. An exercise device as defined in claim 14 wherein any member of the group consisting of the first frame member, the second frame member, the leg press bar and the crank arms of the pedals forms an acute angle of less than twenty degrees with respect to each of the remaining members of said group and without forming an angle greater than twenty degrees with respect any other member of said group when said frame members are pivoted into the storage position.

16. An exercise device as defined in claim 11, wherein wherein each frame member include a vertically upwardly extending portion when the frame means is disposed in the operative "A" frame position, and wherein each support foot extends laterally outwardly on opposing side of the vertically upwardly extending portion.

17. An exercise device comprising:

frame means for supporting exercise apparatus located thereon, said frame means comprising:

a first frame member having an upper portion pivotally attached to an upper portion of a second frame member for enabling said frame member to be pivoted (I) outwardly away from each other into an operative position during periods of use such that said frame members define and "A" frame shape, and (ii) inwardly toward each other into a storage position during periods of nonuse;

wherein the exercise apparatus comprises exercise means disposed on at least one of the frame members for resisting movement of a user, said exercise means including:

a leg press bar disposed in swinging engagement with an upper half of at least one of the frame members of said frame means; a plurality of pedals disposed in rotating engagement with at least one of the frame members of said frame means; and a plurality of resistance pulls attached to at least one of the frame members of said frame means.

18. An exercise device as defined in claim 17, wherein the exercise apparatus further comprises:

a plurality of pedals disposed in rotating engagement with at least one of the frame members of said frame means; and a plurality of resistance pulls attached to at least one of the frame members of said frame means.

19. An exercise device as defined in claim 17, wherein the pivotal attachment of the frame members is sufficient to enable said frame members to be pivoted inwardly toward each other into a storage position during periods of nonuse, said exercise device further comprising a plurality of pedals disposed in rotating engagement with at least one of the frame members of said frame means, and wherein each pedal comprises a crank arm and a foot support rotatably disposed on said crank arm, and wherein each crank arm and the leg press bar are positionable into substantially parallel positions with respect to at least one of the frame members into a compact configuration when said frame members are pivoted into the storage position.

20. An exercise device as defined in claim 19, wherein any member of the group consisting of the first frame member, the second frame member, the leg press bar and the crank arms of the pedals forms an acute angle of less than twenty degrees with respect to each of the remaining members of said group and without forming an angle greater than twenty degrees with respect any other member of said group when said frame members are pivoted into the storage position.

* * * * *